US007378963B1

(12) United States Patent
Begault et al.

(10) Patent No.: US 7,378,963 B1
(45) Date of Patent: May 27, 2008

(54) RECONFIGURABLE AUDITORY-VISUAL DISPLAY

(76) Inventors: Durand R. Begault, P. O. Box 541, San Francisco, CA (US) 94104; Mark R. Anderson, 1532 Belmont Ave., San Carlos, CA (US) 91344; Bryan McClain, 1134 Willow St. APT 1, Fremont, CA (US) 95125; Joel D. Miller, 1242 25th Ave., San Francisco, CA (US) 94122

( * ) Notice: Subject to any disclaimer, the term of this patent is extended or adjusted under 35 U.S.C. 154(b) by 108 days.

(21) Appl. No.: 11/239,449

(22) Filed: Sep. 20, 2005

(51) Int. Cl.
*G08B 1/08* (2006.01)

(52) U.S. Cl. ..... 340/539.29; 340/285; 340/517; 382/115

(58) Field of Classification Search ..... 340/517, 340/286.05, 539.26; 382/115
See application file for complete search history.

(56) References Cited

U.S. PATENT DOCUMENTS 5,448,220 A * 9/1995 Levy ..... 340/539.26
5,689,234 A * 11/1997 Stumberg et al. ..... 340/521
5,793,882 A * 8/1998 Piatek et al. ..... 382/115
5,990,793 A * 11/1999 Bieback ..... 340/573.1
6,268,798 B1 * 7/2001 Dymek et al. ..... 340/573.1
6,778,081 B2 * 8/2004 Matheny ..... 340/506
7,019,652 B2 * 3/2006 Richardson ..... 340/573.1
7,064,660 B2 * 6/2006 Perkins et al. ..... 340/539.13

OTHER PUBLICATIONS

Begault T, et al., Audio-Visual Communication Monitoring System for Enhance . . . , Working Together: R&D Partnerships in Homeland Security Conference, Apr. 27-28, 2005, Boston, MA.

* cited by examiner

*Primary Examiner*—Jeffery Hofsass
*Assistant Examiner*—Edny Labbees
(74) *Attorney, Agent, or Firm*—John F. Schipper; Robert M. Padilla

(57) ABSTRACT

System and method for visual and audible communication between a central operator and N mobile communicators (N≧2), including an operator transceiver and interface, configured to receive and display, for the operator, visually perceptible and audibly perceptible signals from each of the mobile communicators. The interface (1) presents an audible signal from each communicator as if the audible signal is received from a different location relative to the operator and (2) allows the operator to select, to assign priority to, and to display, the visual signals and the audible signals received from a specified communicator. Each communicator has an associated signal transmitter that is configured to transmit at least one of the visual signal and the audio signal associated with the communicator, where at least one of the signal transmitters includes at least one sensor that senses and transmits a sensor value representing a selected environmental or physiological parameter associated with the communicator.

12 Claims, 9 Drawing Sheets

Basic System Overview Diagram

Basic System Overview Diagram

RECONFIGURABLE AUDITORY-VISUAL DISPLAY

ORIGIN OF THE INVENTION

This invention was made, in part, by one or more employees of the U.S. government. The U.S. government has the right to make, use and/or sell the invention described herein without payment of compensation therefor, including but not limited to payment of royalties.

FILED OF THE INVENTION

This invention relates to analysis and display of signals representing location and angular orientation of a human's body.

BACKGROUND OF THE INVENTION

In many environments, a central operator communicates with, and receives visual signals and/or auditory signals from, two or more mobile or non-mobile communicators who are responding to, or relaying information on, one or more events in the field through a signaling channel associated (only) with that communicator. The event(s) may be a medical emergency or hazardous substance release or may be associated with continuous monitoring of a non-emergency situation. The visual and/or auditory signals may be displayed through time sharing of the displays received by the operator. However, this approach treats all such signals substantially equally and does not permit fixing the operator's attention on a display that requires sustained attention for an unpredictable time interval. This approach also does not permit the operator to quickly (re)direct attention to, and assign temporary priority to, two or more communicators, out of the sequence set by the time sharing procedure. This approach, by itself, does not provide information on the present location, present angular orientation and present environment of the communicator.

What is needed is a signal analysis and communication system that (1) accepts communication signals from multiple signal sources simultaneously, (2) permits a signal recipient to assign priority to, or to focus on, a selected audio signal source. Preferably, the system should allow determination of location and angular orientation of a person associated with a signal source and should permit visual, audible and/or electronic monitoring of one or more parameters associated with the health or operational fitness of the person. The system should also allow easy prioritization of a selected individual's audio and visual communication, while allowing other communication channels to be monitored in the background.

SUMMARY OF THE INVENTION

These needs are met by the invention, which provides a method and system that allows auditory and visual monitoring of multiple, simultaneous communication channels at a centralized command post ("local control center") with enhanced speech intelligibility and ease of monitoring visual channels; visual feedback as to which channel(s) has active audible communications; and orientation information for each of N monitored communicators ($N \geqq 1$). Each monitored communicator wears a hard hat equipped with lighting according to O.S.H.A. regulations, headphone, throat microphone and visual image transmitter (e.g., a camera). The local control center, which may be embodied within a hardened laptop computer or equivalent device, includes software for modifying input audio signals via compression and binaural (three-dimensional audio) signal processing, combining these audio signals with visual video, location, angular orientation and situational awareness information, and presenting the audio signals from perceived locations that are spatially separated.

Each of N communicator channels is assigned an azimuthal angular sector associated with the apparent sound image perceived through the operator's headset, where N is normally between 2 and 8. Spatial audio filtering, using head-related transfer function filters, as described in "Multichannel Spatialization System for Audio Signals" U.S. Pat. No. 5,483,623, issued to D. Begault and in D. Begault, "Three-dimensional Sound for Virtual Reality and Multimedia, Academic Press, 1994, esp. pp. 39-190 (content incorporated by reference herein), can be provided so that this signal appears to arrive from a specified location within sector number n at the operator's head, with the sector being non-overlapping so that the operator can distinguish signals "received" in angular sector n1 from signals "received" in angular sector n2 ($\neq$n1), even where signals from two or more channels are present.

In U.S. Pat. No. 5,438,623, head related transfer functions ("HRTFs") are measured for each of the left ear and the right ear for a given audio signal for selected azimuthal angles (e.g., ±60° and ±150°) relative to a reference line passing through an operators head, for each of a sequence of frequencies from 0 Hz to about 16,000 Hz, and a measured HRTF is formed for each ear. A synthetic HRTF is then configured, using a multi-tap, finite impulse response filter (e.g., 65 taps) and appropriate time delays, which compares as closely as possible to the measured HRTF over the frequency range of interest and which is used to "locate" the virtual source of the audio signal to be perceived by the operator. If the operator or an azimuthal angle is changed, the measured HRTF and synthetic HRTF must be changed accordingly.

Location and angular orientation of a communicator or helmet are estimated or otherwise determined using digital compass, global positioning system (GPS), general system mobile (GSM) or other location system, and are presented to the operator.

The invention creates a multi-model communications environment that increases the situational awareness for the operator (controller). Situational awareness is increased by a number of innovations such as spatially separating each voice communication channel, allowing a single voice channel to be prioritized while still allowing other channels to be monitored. This allows the controller to view real time video from each of the controlled communicators, allowing sensor data from these communicators to be electronically collected separately, rather than being collected over the voice channel. The approach also provides an interface for the operator to record and transmit event data. In addition, each communications channel is equipped with a video indicator that allows the operator to determine who is speaking and from which communication channel the signal is being received.

Examples of situations in which the invention will be uniquely useful include the following:

(1) A local control center in a search and rescue or monitoring operation often requires one operator with a portable communication device to focus attention simultaneously, both visually and audibly, on as many as four different personnel at once. The operator must be able to focus on a specific communicator without sacrificing active monitoring (e.g., in the background) of other communicators. By supplying a coordinated spatial display of visual and auditory information, greater ease of segregation of information (auditory, visual, state situation) may be conveyed.

(2) In high stress situations, such as search and rescue operations, a local controller must be provided with an optimal display of information, both visually and audibly, concerning both rescue personnel and the surrounding environment, such as a collapsed structure. A local controller must frequently act quickly on the basis of available (often incomplete) information because of the time-sensitive nature of rescue operations. An optimal display must provide as much information as the operator can accommodate, and as quickly and as unambiguously as possible, in a manner that allows selective prioritization of information, as required.

(3) Prior art for portable systems for rescue applications utilizes multiple audio communication channels mixed in and transmitted through a single channel, without video. The communication source (video and audio channels) are not prioritized to the operator. Supporting technology developed by one of the inventors (Begault., U.S. Pat. No. 5,438,623, 1995) allows spatialization of signals but does not contain a mechanism for prioritization.

DESCRIPTION OF BEST MODES OF THE INVENTION

Figure 1:
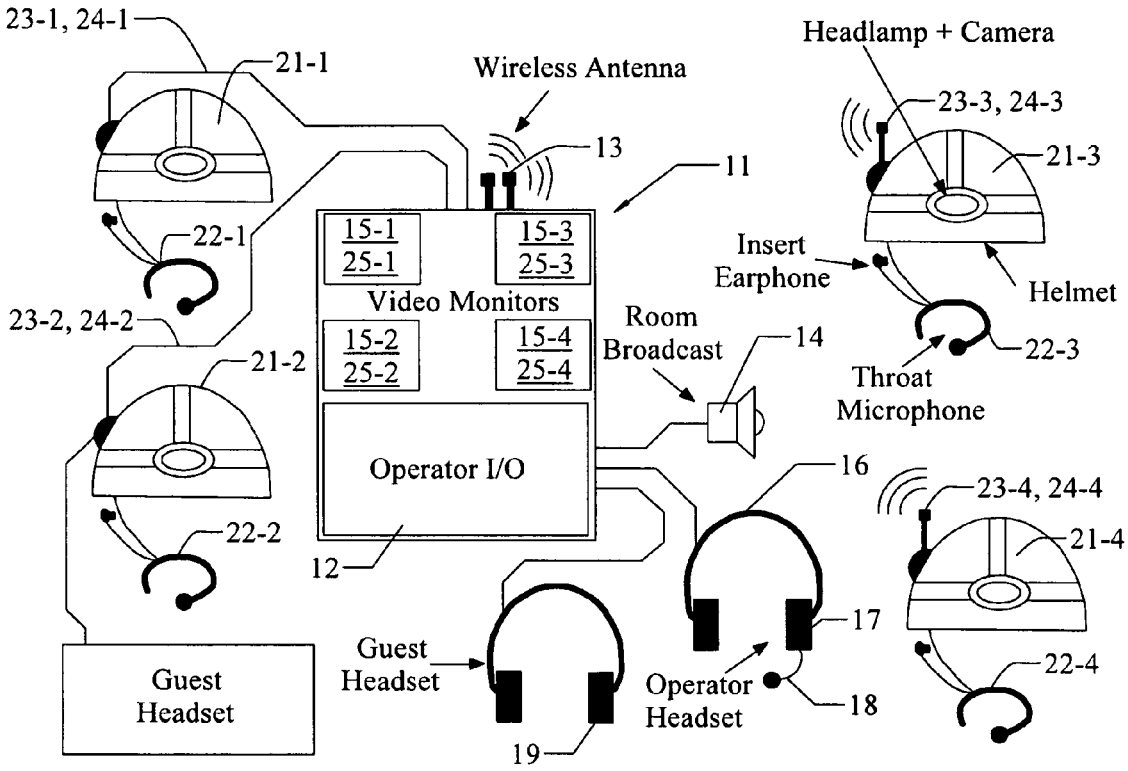
FIG. 1 schematically illustrates an operator interface with a plurality of communicators according to an embodiment of the invention.

FIG. 1 schematically illustrates an operator interface 11 with several communicators (here, four), spaced apart from the operator, according to the invention. The operator interface 11 includes an operator I/O module 12, connected to a wireless, N-channel antenna 13, an optional room audio broadcast module 14, and a plurality of video monitors, 15-n (n=1, . . . , N; here, N=4), where the monitor 15-n receives and displays visual images associated with a helmet 21-n worn or carried by communicator no, n. The operator is connected to the operator interface by an operator headset 16, which includes operator headphones 17 and an operator microphone 18 that provides broadcast or multi-cast audio signals for transmission over the N-channel transmission system to one, more or all of the N communicators. Optionally, the operator interface also includes a guest headset 19, having headphones only, for use by a guest to monitor, with no audible input, audio information received by the operator.

A communicator helmet 21-n has an associated communicator headset 22-n and an associated communicator antenna 23-n for communicating, audibly and otherwise, with the operator. Optionally, the communicator helmet 21-n also has one or more (preferably, at least three) short- or medium range, spaced apart radio frequency identification devices ("RFIDs") 24-n(k) (k=1, . . . , K;K≧3), positioned on the helmet and/or on the body of the communicator. Each RFID communicates (one way or two way) with three or more spaced apart locator modules 25-m (m=1, 2, 3, . . . ) that receive RFID signals from each RFID 24-n(k) and that estimate, by triangulation, the present location of the RFID, as discussed in Appendix 1. The RFID signals received from each RFID may be replaced by GPS signals or GSM signals received from three or more GPS signal receivers or GSM signal receivers, respectively, and the collection of locator modules 25-m can be replaced by a collection of GPS satellites or by a collection of GSM base stations (now shown in FIG. 1). In certain hazardous situations, it may be preferable to provide periodic information on each of several communicator body locations, such as head, both wrists and both feet.

Where the three dimensional location coordinates of the communicator or of the helmet are to be estimated and provided for the operator, use of a single RFID on the communicator's body or helmet may be sufficient. However, where the angular orientation of the communicator's body or helmet is also to be estimated and provided for the operator, preferably at least three spaced apart RFIDs should be provided on the communicator's body or helmet; and angular orientation can also be estimated as set forth in Appendix 1.

Figure 2:
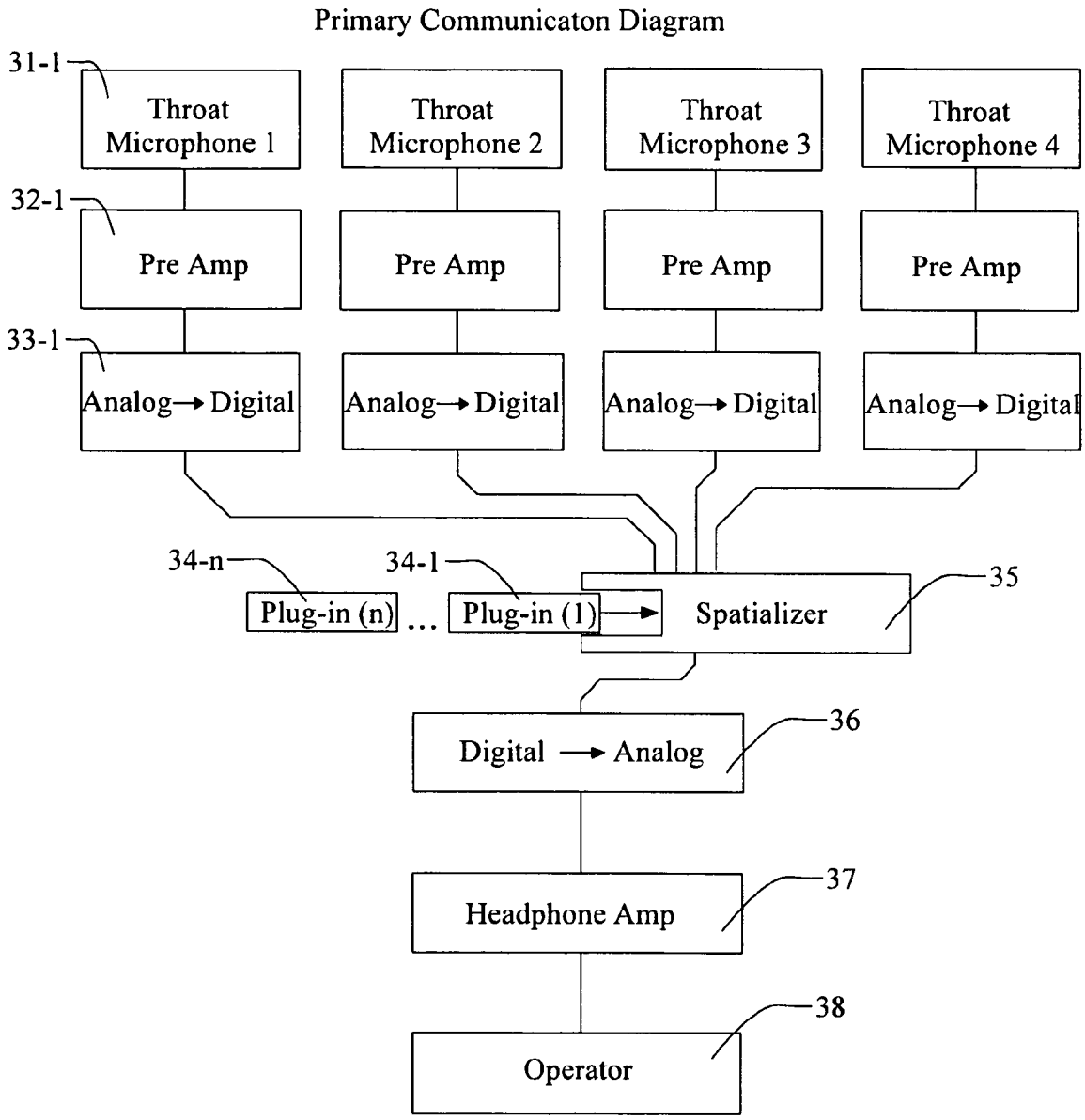
FIG. 2 schematically illustrates operator communication with each of several communicators systems.

FIG. 2 schematically illustrates a primary system for audible communication between an operator and a plurality N of communicators (here, N=4). Each communicator subsystem includes a throat microphone 31-n (n=1, . . . , , N), a pre-amplifier 32-n, and an analog-to-digital converter ("ADC") 33-n. The signals issued by a communicator (n) are received by a plug-in module spatializer 34-n that assigns a non-overlapping azimuthal angular sector associated with the operator's headset to each of N communicators, where N is normally between 2 and 8. Spatial audio filtering of the audio signal received by each of the operator's two ears from communicator number n (=1, . . . , N), using a pair of head-related transfer function filters that produce the correct spectral, phase and intensity cues for a specified auditory location, is arranged so that this signal appears to arrive from a specified sector number n at the operator's head. The sectors are preferably non-overlapping so that the operator can distinguish signals "received" is angular sector n1 from signals "received" in angular sector n2 (≠n1), even where signals from two or more channels are present. The operator can also use voice timbre and linguistic characteristics to distinguish between signals received in two or more channels, substantially simultaneously.

A "prioritization system" allows a selected channel to be brought "front and center" to an unused central angular sector in the display, allowing the operator to focus on an individual communicator while not sacrificing active monitoring of the other communicators. The spatializer output signals are received and converted to analog format by a digital-to-analogy converter ("DAC") 36, with the converted signal being received by a headphone amplifier 37 to provide audibly perceptible signals for the operator 38.

Optionally, the visual and location/orientation ("L/O") information received from each communicator channel can be presented in time sharing mode, where each of the N channels receives and uses a time slot or time interval of fixed or variable length $\Delta t(n)$ in a larger time interval of length $\Delta T$ ($>\Sigma_n \Delta t(n)$), where the remaining time, of length $\Delta T - \Sigma_n \Delta t(n)$, is reserved for administrative signals and for special or emergency service and/or exception reporting, as required by a specified channel, using a prioritization procedure for the specified channel. Sensing of a non-normal environmental situation at a communicator's location optionally assigns this remainder time (of length $\Delta T-\Sigma_n\Delta t(n)$) to reporting and display on that channel. Preferably, the time interval lengths $\Delta t(n)$ should not exceed a temporal length that would cause communication through the channels to appear non-continuous. The audio signals received from a communicator are preferably presented using the spatializer, as discussed in the preceding.

Figure 3:
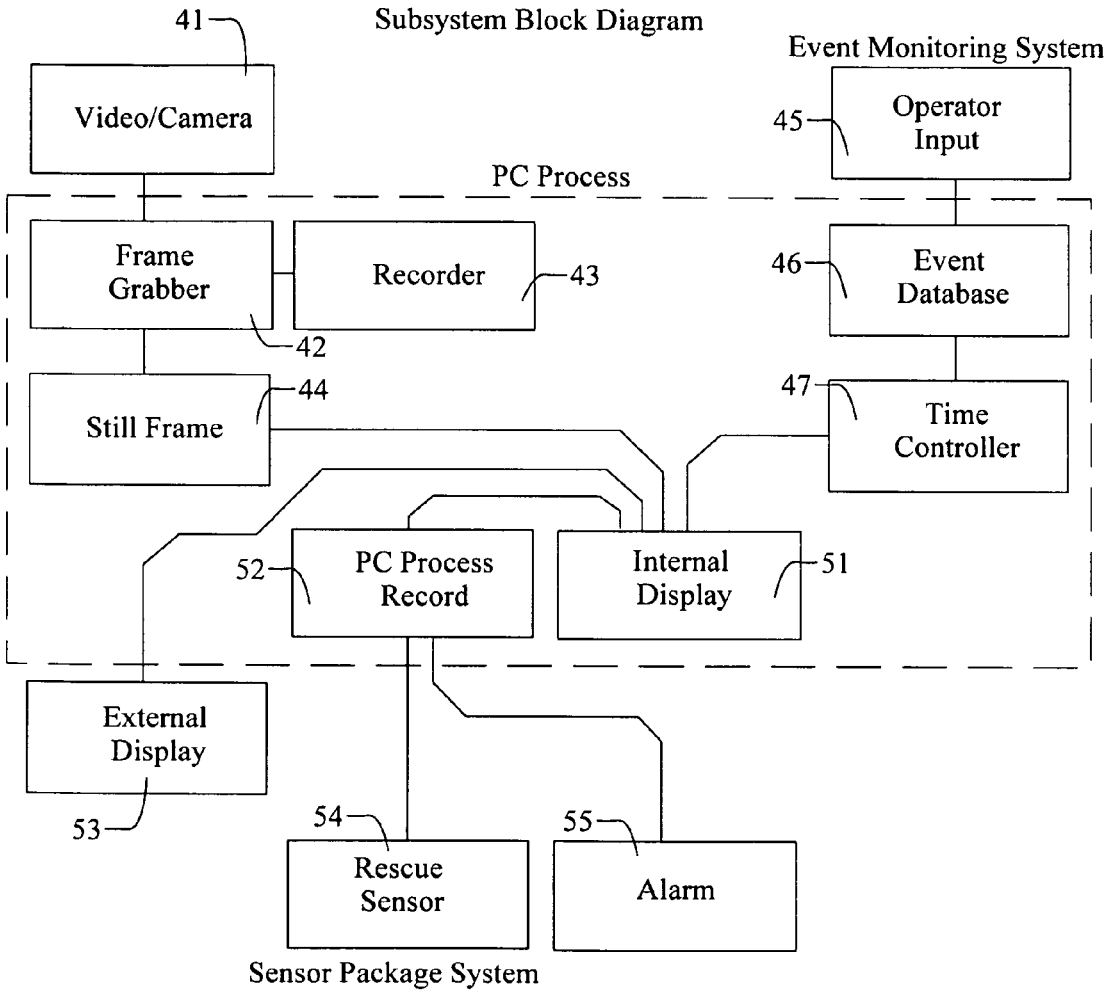
FIG. 3 schematically illustrates a communicator subsystem.

FIG. 3 is a block diagram illustrating combined operation of a video/camera system 41 and an operator input system 45. Image output signals from the video camera system 41 are received by a frame grabber 42 and associated image recorder 43. The frame grabber 42 produces an ordered sequence of still frames that are received and processed by a still frame processor 44 to provide a selected sequence of visual images. The operator input system 45 facilitates specification of one or more events and associated event information contained in an event database 46. Time interval for display of the specified event information are monitored by a time controller 47.

Still frame images from the still frame processor and corresponding event information from the event database 46 are received and combined in an internal display module 51 and associated processing and recording module 52. An optional external display module 53 receives and displays selected images and alphanumeric information from the internal display 51. Selected information from the processing and recording module 52 is received by a rescue sensor module 54, which checks each of a group of situation parameters against corresponding event threshold values to determine if a "rescue" or emergency situation is present. If a rescue or emergency situation is present, an audibly perceptible alarm signal and/or visually perceptible alarm signal is provided by an alarm module 55 to advise the operator (and, optionally, one or more of the communicators) concerning the situation. Optionally, the alarm signal may have two or more associated alarm modes, corresponding to two or more distinct classes of alarm events.

A first class of alarm event parameters specifies a maximum time interval $\Delta t(max;m)$ during which an event (no. m) can persist and/or a minimum time interval during which an event (no. m) should persist; a range, $\Delta t(min;m) \leqq t \leqq \Delta t(max;m)$, is thus specified, where $\Delta t(min;m)$ may be 0 or $\Delta t(max;m)$ may be $\infty$.

As a first example, the system may specify that, if the communicator is substantially motionless and (optionally) supine (estimated using knowledge of the communicator's angular orientation) for a time interval exceeding 30 sec, a communicator-down alarm will be issued. As a second example, if the system senses that the communicator has not drawn a breath within a preceding time interval of specified length (e.g., within the last 45 sec), a communicator-disabled alarm will be issued.

As a third example, an exposure-versus-time threshold curve can be provided for exposure (1) to a specified hazardous material (e.g., trichloroethylene or polychlorinated biphenols), (2) to specified energetic particles (e.g., alphas, betas, gammas, X-rays, ions or fission fragments) or (3) to noise or other sound at or above a specified decibel level (e.g., 90 dB and above); and a sensor carried on a communicator's body or helmet can periodically sense (e.g., at one-sec intervals) the present concentration or intensity of this substance and issue an exposure alarm signal when the time-integrated exposure exceeds the threshold value.

In addition to environmental parameters, physiological parameters, such as heart rate, breathing rate; temperature of a selected body component and/or pH of blood or of another body fluid, may be measured and compared to a permitted range for that parameter.

Figure 4:
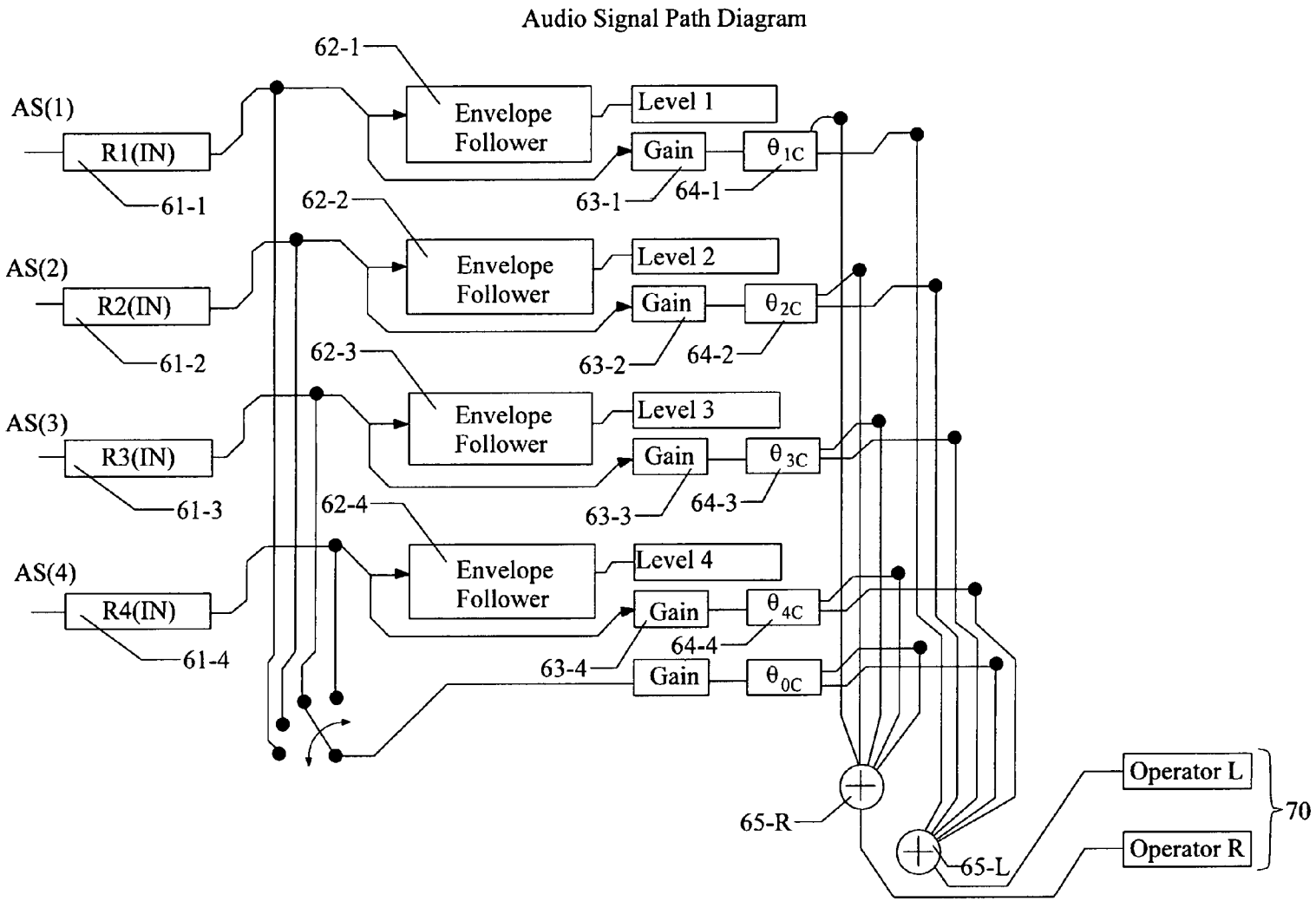
FIG. 4 illustrates an audio signal path for an operator subsystem.
Figure 5:
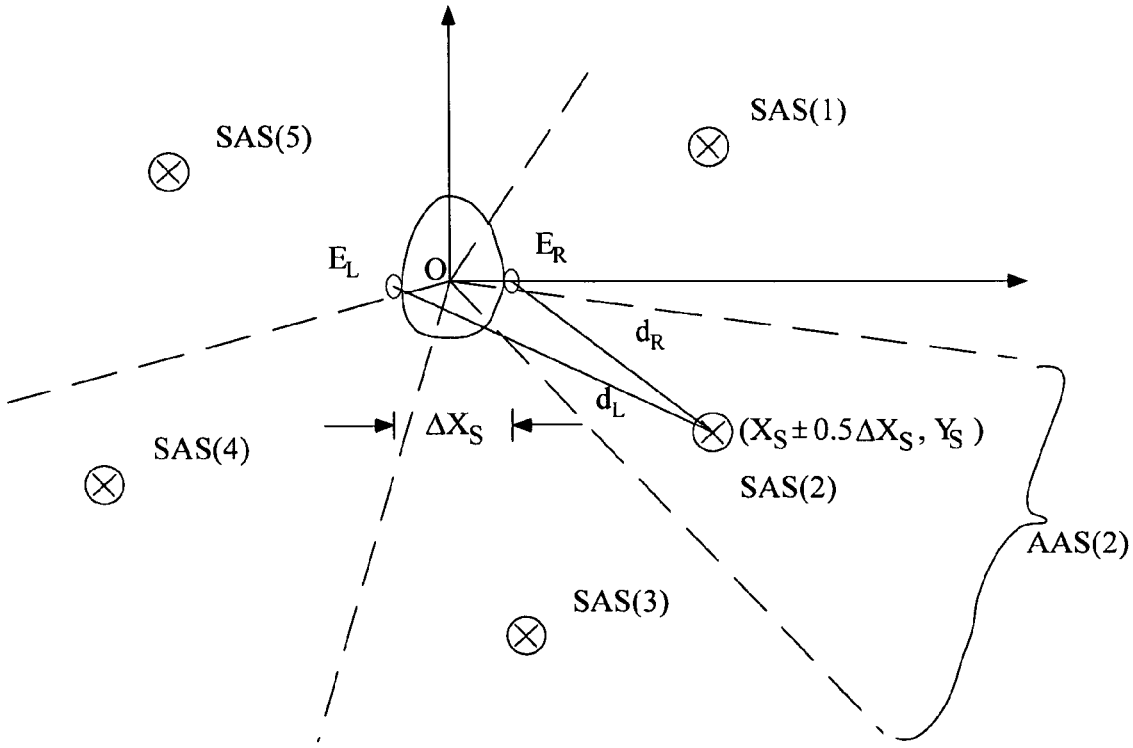
FIG. 5 illustrates use of the azimuthal angular sectors.

FIG. 4 is a block diagram illustrating processing of audio signals from N channels using a spatializer according to the invention. An audio signal AS(n) is received at a receiver 61-n (n=1, . . . , N) and processed initially by an envelope follower 62-n to determine a present level or intensity of the audio signal. The received signal is also processed by a gain module 63-n and a spatial audio filtering module 64-n that introduces the correct right ear-left ear audio differences for the operator for this channel so that the operator at 70 will sense that the audio signal AS(n) is "received" within the azimuthal angular sector AAS(n). The N azimuthal angular sectors AAS(n) are non-overlapping and may have the same or (more likely) different angular widths associated with each such sector, depending upon operator ear sensitivity, signal frequencies and other variables. For example, where N=8 channels are used, as indicated in FIG. 5, the azimuthal angular sectors ($\theta<\theta<\theta 2$) might be chosen as AAS(n=1): $30°<\theta<42°$,
AAS(n=2): $42°<\theta<64°$,
AAS(n=3): $64°<\theta<129°$,
AAS(n=4): $129°<\theta<180°$,
AAS(n=5): $180°<\theta<231°$ ($-180°<\theta<-129°$),
AAS(n=6): $231°<\theta<296°$ ($-129°<\theta<-64°$),
AAS(n=7): $296°<\theta<318°$ ($-54°<\theta<-42°$),
AAS(n=8): $318°<\theta<335°$. ($-42°<\theta<-25°$), A "front and center" angular sector, defined, for example, by $-30°$ ($330°$)$<\theta<30°$, is reserved for a channel signal that is selected by the operator to be given special prominence. The sectors need not be symmetric about either $\theta=0°$ or about $\theta=180°$ or about any other azimuthal angle.

FIG. 5 illustrates use of the azimuthal angular sectors AAS(n) with N=5 channels, indicating a perceived "source" SAS(n) of an audio signal associated with each channel. Differential spatial audio filtering for channel n=2, for example, can be implemented as follows. The distances of the perceived source SAS(n=2) from the operator's left ear and from the operator's right ear and the associated phase difference $\Delta\phi$ are estimated by $$d_L=\{(x_S+0.5\Delta x_S)^2+y_S^2\}^{1/2}, \quad (1)$$

$$d_R=\{(x_S-0.5\Delta x_S)^2+y_S^2\}^{1/2}, \quad (2)$$

$$\Delta\phi=(d_L-d_R)/\lambda, \quad (3)$$

where $\lambda$ is a representative audio wavelength of the perceived source signal and $(x,y)=(\pm 0.5\Delta x_S,0)$ are the location coordinates of the operator's right and left ears relative to an origin O within the operator's head.

Figure 6A:
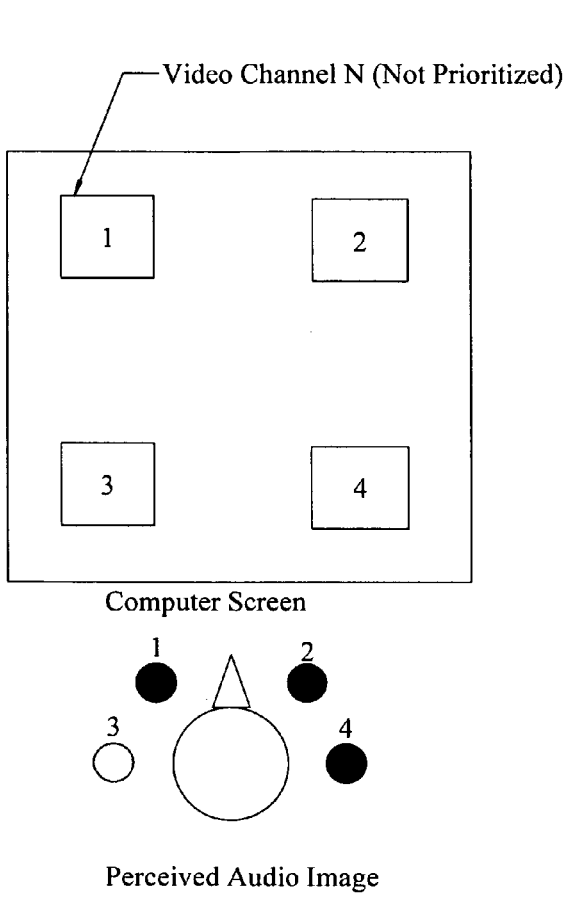
FIGS. 6A and 6B illustrate computer screens and perceived audio images, where no channel is prioritized (6A) and where one channel is prioritized (6B).
Figure 6B:
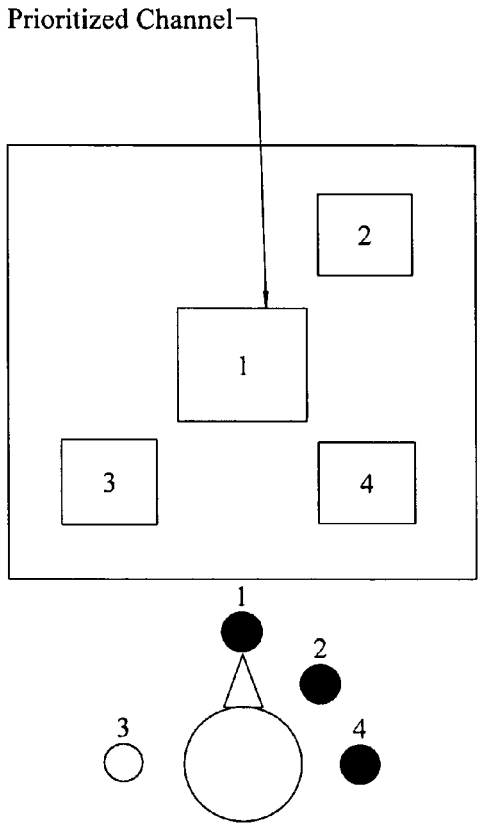

FIGS. 6A and 6B illustrate computer screens and perceived audio images, where no channel is prioritized (9A) and where channel number 1 is prioritized (9B). In FIG. 6A, no channel is prioritized, and the four channel icons, corresponding to communicators no. n=1, 2, 3, 4, are located at four corners of a square, with the center region unoccupied. The virtual locations for the four audio signals in FIG. 9A correspond approximately to the azimuthal angles $\theta=-45°$, $+45°$, $-90°$ and $+90°$, respectively. Where N communicators are tracked (N=2-8), the square can be replaced by a polygon with N sides (an N-gon), with one channel icon located at each of the N vertices or adjacent to one of the N sides of the polygon. The configuration in FIG. 6A corresponds to an operator facing and communicating with a group of N persons, with no one of these persons being given special attention.

Where a single channel (e.g., n=1) is prioritized, the channel icon is moved from its non-prioritized location to a "front and center" location at the center of the screen, as illustrated in FIG. 6B. Corresponding to this choice of channel priority, the virtual location for the corresponding audio signal is preferably moved to a reserved central sector (e.g., $-25°<\theta<30°$). Alternatively, the audio signal for the prioritized channel can be audibly displayed with either no filtering (no gain equalization) or with filtering corresponding to a virtual location of $\theta=0°$. Where another channel (no. n) is chosen for prioritization, the treatment of the virtual location is analogous. Optionally, the visual signal corresponding to the prioritized channel can also be displayed on the same screen or on a different screen (not shown in FIGS. 6A and 6B).

APPENDIX 1

Development of Location Relations

Figure 7:
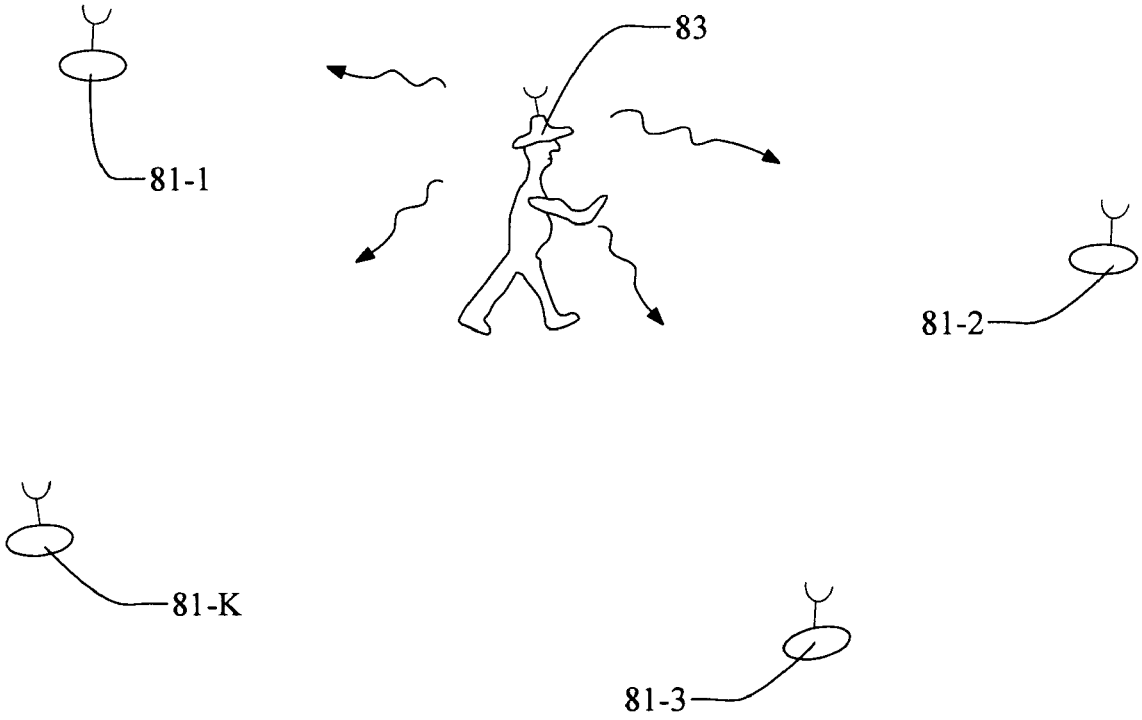
FIGS. 7, 8 and 9 illustrate use of at least one RFID, or of at least three RFIDs, to determine location or angular orientation of a communicator.

Consider a location determination (LD) system having at least three spaced apart signal receivers 81-k (k=1, . . . , K(K≧4) in FIG. 7, each capable of receiving a signal transmitted by a signal source 83 and of determining the time an location determination ("LD") signal is received, preferably with an associated inaccuracy no more than about one nanosecond (nsec). The signal receivers 81-k have known locations $(x_k,y_k,z_k)$, preferably but not necessarily fixed, in a Cartesian coordinate system, and the source 83 is mobile and has unknown coordinates (x,y,z) that may vary slowly with time t. Assuming that the LD signal is transmitted by the source 83 at a known or determinable time, t=t0, and propagates with velocity c in the ambient medium (assumed isotropic), the defining equations for determining the coordinates (x,y,z) at a given time t become $$\{(x-x_k)^2+(y-y_k)^2+(z-z_k)^2\}^{1/2}=c\cdot\Delta t_k-b, \tag{A1}$$

$$\Delta t_k=t_k-t0, \tag{A2}$$

$$b=c\tau, \tag{A3}$$

where $t_k$ is the time the transmitted LD signal is received by the receiver no. k and $\tau$ is a time shift (unknown, but determinable) at the source that is to be compensated.

By squaring Eq. (A1) for index j and for index k and subtracting these two relations from each other, one obtains a sequence of K−1 independent relations $$\begin{aligned}2x\cdot(x_k-x_j)+2y\cdot(y_k-y_j)+2z\cdot(z_k-z_j)+\\ \{(x_k^2-x_j^2)+(y_k^2-y_j^2)+(z_k^2-z_j^2)\}=c^2\cdot(\Delta t_k^2-\Delta t_j^2)-2b\cdot c\cdot\Delta t_{jk},\end{aligned} \tag{A4}$$

$$\Delta t_{jk}=\Delta t_j-\Delta t_k=t_j-t_k. \tag{A5}$$

Equations (A4) may be expressed as K−1 linear independent relations in the unknown variable values x, y, z and b.

If K≧5, any four of these K−1 relations alone suffice to determine the variable values x, y, z and b. In this instance, the four relations in Eq. (A4) for determination of the location coordinates (x,y,z) and the equivalent time shift b=cτ can be set forth in matrix form as $$\begin{vmatrix}(x_1-x_2) & (y_1-y_2) & (z_1-z_2) & c\Delta t_{12},\\ (x_1-x_3) & (y_1-y_3) & (z_1-z_3) & c\Delta t_{13},\\ (x_1-x_4) & (y_1-y_4) & (z_1-z_4) & c\Delta t_{14},\\ (x_1-x_5) & (x_1-y_5) & (z_1-z_4) & c\Delta t_{15},\end{vmatrix}\begin{vmatrix}x\\ y\\ z\\ b\end{vmatrix}=\begin{vmatrix}\Delta D_{12},\\ \Delta D_{13},\\ \Delta D_{14},\\ \Delta D_{15},\end{vmatrix} \tag{A6}$$

$$\Delta D_{12}=c^2\cdot(\Delta t_1^2-\Delta t_2^2)/2-\{(x_1^2-x_2^2)+(y_1^2-y_2^2)+(z_1^2-z_2^2)\}/2, \tag{A7-1}$$

$$\Delta D_{13}=c^2\cdot(\Delta t_1^2-\Delta t_3^2)/2-\{(x_1^2-x_3^2)+(y_1^2-y_3^2)+(z_1^2-z_3^2)\}/2, \tag{A7-2}$$

$$\Delta D_{14}=c^2\cdot(\Delta t_1^2-\Delta t_4^2)/2-\{(x_1^2-x_4^2)+(y_1^2-y_4^2)+(z_1^2-z_4^2)\}/2, \tag{A7-3}$$

$$\Delta D_{15}=c^2\cdot(\Delta t_1^2-\Delta t_5^2)/2-\{(x_1^2-x_5^2)+(y_1^2-y_5^2)+(z_1^2-z_5^2)\}/2, \tag{A7-4}$$

If, as required here, any three of the receivers are noncolinear and the five receivers do not lie in a common plane, the 4×4 matrix in Eq. (A6) has a non-zero determinant and Eq. (A6) has a solution (x,y,z,b).

If K=4, the three relations in Eq. (A4) plus one additional relation can determine the unknown values. To develop this additional relation, express Eqs. (A4) in matrix form as $$\begin{vmatrix}(x_1-x_2) & (y_1-y_2) & (z_1-z_2)\\ (x_1-x_3) & (y_1-y_3) & (z_1-z_3)\\ (x_1-x_4) & (y_1-y_4) & (z_1-z_4)\end{vmatrix}\begin{vmatrix}x\\ y\\ z\end{vmatrix}=\begin{vmatrix}\Delta D_{12}-b\cdot c\Delta t_{12},\\ \Delta D_{13}-b\cdot c\Delta t_{13},\\ \Delta D_{14}-b\cdot c\Delta t_{14},\end{vmatrix} \tag{A8}$$

$$\Delta D_{12}=c^2\cdot(\Delta t_1^2-\Delta t_2^2)/2-\{(x_1^2-x_2^2)+(y_1^2-y_2^2)+(z_1^2-z_2^2)\}/2, \tag{A9-1}$$

$$\Delta D_{13}=c^2\cdot(\Delta t_1^2-\Delta t_3^2)/2-\{(x_1^2-x_3^2)+(y_1^2-y_3^2)+(z_1^2-z_3^2)\}/2, \tag{A9-2}$$

$$\Delta D_{14}=c^2\cdot(\Delta t_1^2-\Delta t_4^2)/2-\{(x_1^2-x_4^2)+(y_1^2-y_4^2)+(z_1^2-z_4^2)\}/2, \tag{A9-3}$$

These last relations are inverted to express x, y and z in terms of b:

$$M^{-1}\begin{vmatrix}\Delta D_{12}-b\cdot c\Delta t_{12},\\ \Delta D_{13}-b\cdot c\Delta t_{13},\\ \Delta D_{14}-b\cdot c\Delta t_{14},\end{vmatrix}=\begin{vmatrix}x\\ y\\ z\end{vmatrix} \tag{A10}$$

$$M=\begin{vmatrix}(x_1-x_2) & (y_1-y_2) & (z_1-z_2)\\ (x_1-x_3) & (y_1-y_3) & (z_1-z_3)\\ (x_1-x_4) & (y_1-y_4) & (z_1-z_4)\end{vmatrix} \tag{A11}$$

$$M^{-1}=\begin{vmatrix}m'_{11} & m'_{12} & m'_{13}\\ m'_{21} & m'_{22} & m'_{23}\\ m'_{31} & m'_{32} & m'_{33}\end{vmatrix}, \tag{A12}$$

$$\begin{aligned}x=m'_{11}(\Delta D_{12}-b\cdot c\Delta t_{12})+\\ m'_{12}(\Delta D_{13}-b\cdot c\Delta t_{13})+m'_{13}(\Delta D_{14}-b\cdot c\Delta t_{14}),\end{aligned} \tag{A13-1}$$

$$\begin{aligned}y=m'_{21}(\Delta D_{12}-b\cdot c\Delta t_{12})+\\ m'_{22}(\Delta D_{13}-b\cdot c\Delta t_{13})+m'_{23}(\Delta D_{14}-b\cdot c\Delta t_{14}),\end{aligned} \tag{A13-2}$$

$$\begin{aligned}x=m'_{31}(\Delta D_{12}-b\cdot c\Delta t_{12})+\\ m'_{32}(\Delta D_{13}-b\cdot c\Delta t_{13})+m'_{33}(\Delta D_{14}-b\cdot c\Delta t_{14}),\end{aligned} \tag{A13-3}$$

These expressions for x, y and z in terms of b in Eq. (A10) are inserted into the "square" in Eq. (A1), $$\{(x-x_1)^2+(y-y_1)^2+(z-z_1)^2\}=(c\cdot\Delta t_1)^2-2b.c\cdot\Delta t_1+b^2, \tag{A14}$$

to provide a quadratic equation for b, $$A\cdot b^2-2B\cdot b+C=0, \tag{A15}$$

$$A=\{m'_{11}\Delta t_{12}+m'_{12}\Delta t_{13}+m'_{13}\Delta t_{14}\}^2+\{m'_{21}\Delta t_{12}+m'_{22}\Delta t_{13}+m'_{23}\Delta t_{14}\}^2+\{m'_{31}\Delta t_{12}+m'_{32}\Delta t_{13}+m'_{33}\Delta t_{14}\}^2, \tag{A16-1}$$

$$B=\{m'_{11}\Delta D_{12}+m'_{12}\Delta D_{13}+m'_{13}\Delta D_{14}-x_1\}\{m'_{11}\Delta t_{12}+m'_{12}\Delta t_{13}+m'_{13}\Delta t_{14}\}+\{m'_{11}\Delta D_{12}+m'_{12}\Delta D_{13}+m'_{13}\Delta D_{14}-y_1\}\{m'_{11}\Delta t_{12}+m'_{12}\Delta t_{13}+m'_{13}\Delta t_{14}\}+\{m'_{11}\Delta D_{12}+m'_{12}\Delta D_{13}+m'_{13}\Delta D_{14}-z_1\}\{m'_{11}\Delta t_{12}+m'_{12}\Delta t_{13}+m'_{13}\Delta t_{14}\}, \tag{A16-2}$$

$$C=\{m'_{11}\Delta D_{12}+m'_{12}\Delta D_{13}+m'_{13}\Delta D_{14}-x_1\}^2+\{m'_{21}\Delta D_{12}+m'_{22}\Delta D_{13}+m'_{23}\Delta D_{14}-y_1\}^2+\{m'_{31}\Delta D_{12}+m'_{32}\Delta D_{13}+m'_{33}\Delta D_{14}-z_1\}^2, \tag{A16-3}$$

The solution b having the smaller magnitude is preferably chosen as the solution to be used. Equations (A15) and (A13-j) (j=1, 2, 3) provide a solution quadruple (x,y,z,b) for K=4. This solution quadruple (x,y,x,b) is exact, does not require iterations or other approximations, and can be determined in one pass.

This approach can be used, for example, where a short range radio frequency identifier device (RFID) or other similar signal source provides a signal that is received by each of K signal receivers 81-k. The signal source may have its own power source (e.g., a battery), which must be replaced from time to time.

Figure 8:
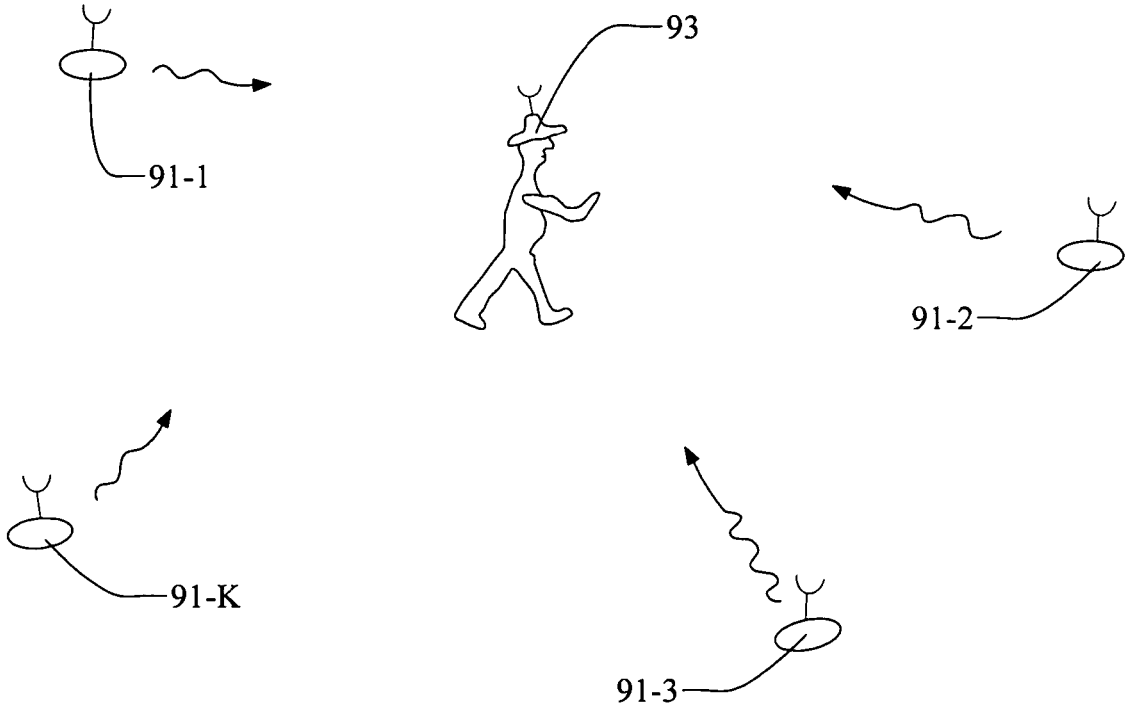

Alternatively, each of the K (K≧3) signal transceivers 91-k can serve as an initial signal source, as illustrated in FIG. 8. Each initial signal source 91-k emits a signal having a distinctive feature (e.g., frequency, signal shape, signal content, signal duration) at a selected time, $t=t_{e,k}$, and each of these signals is received by a target receiver 93 at a subsequent time, $t=t_{r,k}$. After a selected non-negative time delay of length $\Delta t_{d,k}$ (≧0), the target receiver 93 emits a (distinctive) return signal, which is received by the transceiver 91-k at a final time, $t=t_{f,k}=t_{e,k}+2(t_{r,k}-t_{e,k})+\Delta t_k$. The time interval length for one-way propagation from the initial signal source 21-k to the target receiver 93 is thus $$\Delta t_k=t_{r,k}-t_{e,k}=\{t_{f,k}-t_{e,k}-\Delta t_{d,k}\}/2(k-1, \ldots, K), \tag{A17}$$

and the time interval $\Delta t_k$ set forth in Eq. (A14) can be used as discussed in connection with Eqs. (A1)-(A17). However, in this alternative, times at the initial signal sources 91-k are coordinated, and any constant time shift b at target receiver 93 is irrelevant, because only the time differences (of lengths $\Delta t_{r,k}$) are measured or used to determine the time(s) at which the return signal(s) are emitted. Thus, b=0 in this alternative, and the relation corresponding to Eq. (A10) (with b=0) provides the solution coordinates (x,y,z).

The method set forth in connection with Eqs. (A1)-(A7-4) for K≧5 receivers, and the method set forth in connection with Eqs. (A1)-(A17) for K=4 receivers, will be referred to collectively as a "quadratic analysis process" to determine location coordinates (x,y,z) and equivalent time shift b for a mobile object or Carrier.

Determination of Spatial Orientation Relations

The preceding determines location of a single (target) receiver that may be carried on a person or other mobile object (hereafter referred to as a "Carrier"). Spatial orientation of the Carrier can be estimated by positioning three or more spaced apart, noncollinear target receivers on the Carrier and determining the three-dimensional location of each target receiver at a selected time, or within a time interval of small length (e.g., 0.5-5 sec). Where the Carrier is a person, the target receivers may, for example, be located on or adjacent to the Carrier's head or helmet and at two or more spaced apart, noncollinear locations on the Carrier's back, shoulders, arms, waist or legs.

Three spaced apart locations determine a plane Π in 3-space, and this plane Π can be determined by a solution (a,b,c) of the three relations $$x\cdot\cos\alpha+y\cdot\cos\beta+z\cdot\cos\gamma=p, \tag{A18}$$

where α, β and γ are direction cosines of a vector V, drawn from the coordinate origin to the plane Π and perpendicular Π, and p is a (signed) length of V (W. A. Wilson and J. I. Tracey, *Analytic Geometry*, D. C. Heath publ. Boston, Third Ed. 1946, pp. 266-267). Where three noncollinear points, having Cartesian coordinates $(x_i,y_i,z_i)$ (I=1, 2, 3), lie in the plane Π, these coordinates must satisfy the relations $$x_i\cdot\cos\alpha+y_i\cdot\cos\alpha\beta+z_i\cdot\cos\alpha\gamma=p, \tag{A19}$$

and the following difference equations must hold:

$$(x_2-x_1)\cdot\cos\alpha+(y_2-y_1)_i\cdot\cos\beta+(z_2-z_1)\cdot\cos\gamma=0, \tag{A20-1}$$

$$(x_3-x_1)\cdot\cos\alpha+(y_3-y_1)_i\cdot\cos\beta+(z_3-z_1)\cdot\cos\gamma=0. \tag{A20-2}$$

Multiplying Eq. (A20-1) by $(z_3-z_1)$, multiplying Eq. (A20-2) by $(z_2-z_1)$, and subtracting the resulting relations from each other, one obtains $$\{(z_3-z_1)(x_2-x_1)-(z_2-z_1)(x_3-x_1)\}\cos\alpha, +\{(z_3-z_1)(y_2-y_1)-(z_2-z_1)(y_3-y_1)\}\cos\beta=0, \tag{A21}$$

Figure 9:
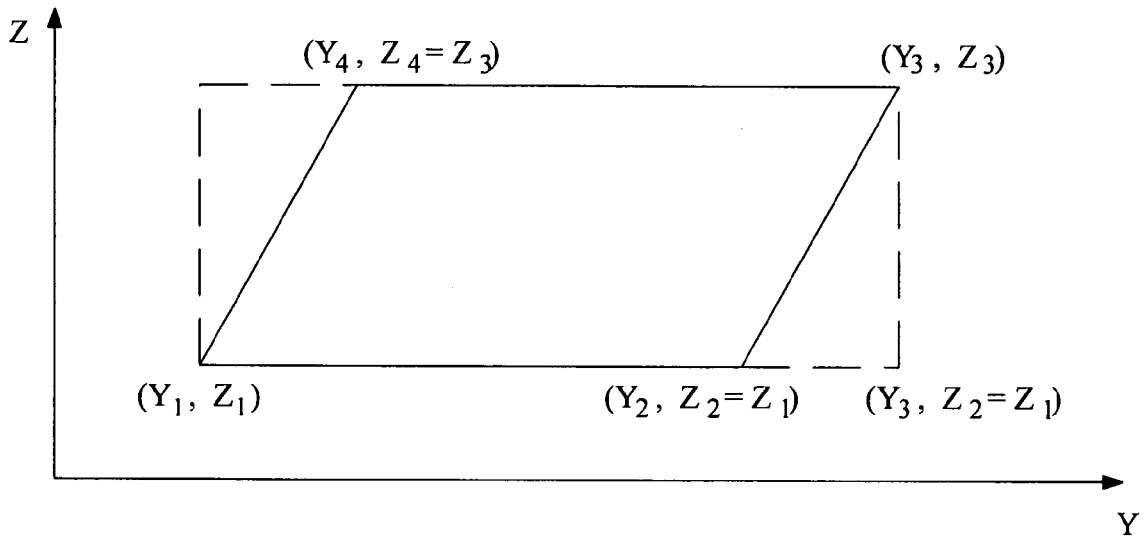

The coefficient $\{(z_3-z_1)(y_2-y_1)-(z_2-z_1)(y_3-y_1)\}$ of cos β is the (signed) area of a parallelogram, rotated to lie in a yz-plane and illustrated in FIG. 9, and is non-zero because the three points $(x_i,y_i,z_i)$ are noncollinear. With $z_2=z_1$ as in FIG. 9, the parallelogram area is computed as follows:

$$\text{Area} = (z_3 - z_1)(y_3 - y_1) \tag{A22}$$

$$= (z_3 - z_1)(y_2 - y_1) - (z_2 - z_1)(y_3 - y_2) \neq 0.$$

Equation (21) has a solution $$\cos\beta=-\{(z_3-z_1)(x_2-x_1)-(z_2-z_1)(x_3-x_1)\}\cos\alpha/\{(z_3-z_1)(y_2-y_1)-(z_2-z_1)(y_3-y_1)\} \tag{A23}$$

Multiplying Eq. (A20-1) by $(y_3-y_1)$, multiplying Eq. (A20-2) by $(y_2-y_1)$, and subtracting the resulting relations, one obtains by analogy a solution $$\cos\gamma=-\}(y_3-y_1)(x_2-x_1)-(y_2-y_1)(x_3-x_1)\}\cos\alpha/\{(z_3-z_1)(y_2-y_1)-(z_2-z_1)(y_3-y_1)\}. \tag{A24}$$

Utilizing the normalization relation for direction cosines, $$\cos^2\alpha+\cos^2\beta+\cos^2\gamma=1, \tag{A25}$$

one obtains from Eqs. (A23), (A24) and (A25) a solution $$\cos\alpha=(\pm1)/\{1+\{(z_3-z_1)(x_2-x_1)-(z_2-z_1)(x_3-x_1)\}^2/\{(z_3-z_1)(y_2-y_1)-(z_2-z_1)(y_3-y_1)\}^2+\{(y_3-y_1)(x_2-x_1)-(y_2-y_1)(x_3-x_1)\}/\{(z_3-z_1)(y_2-y_1)-(z_2-z_1)(y_3-y_1)\}^2\}^{1/2}. \tag{A26}$$

Equations (A23), (A24) and (A26) provide a solution for the direction cosines, cos α, cos β, and cos γ, apart from the signum in Eq. (A26). The signum (±1) in Eq. (A26) is to be chosen to satisfy Eq. (A18) after the solution is otherwise completed. The (signed) length p can be determined form Eq. (A18) for, say, $(x_1,y_1,z_1)$.

A fourth point, having location coordinates $(x,y,z)=(x_4, y_4,z_4)$, lies on the same side of the plane Π as does the origin if $$x_4 \cdot \cos \alpha + y_4 \cdot \cos \alpha\beta + z_4 \cdot \cos \alpha\gamma = p_4 < p, \quad \text{(A27-1)}$$

lies on the opposite side of the plane Π from the origin if $$x_4 \cdot \cos \alpha + y_4 \cdot \cos \alpha\beta + z_4 \cdot \cos \alpha\gamma = p_4 > p, \quad \text{(A27-2)}$$

and lies on the plane Π if $$x_4 \cdot \cos \alpha + y_4 \cdot \cos \alpha\beta + z_4 \cdot \cos \alpha\gamma = p_4 = p, \quad \text{(A27-3)}$$

The fourth point may have location coordinates that initially place this point in the plane Π, for example, within a triangle Tr initially defined by the other three points $(x_i,y_i,z_i)$. As a result of movement of the Carrier associated with the RFIDs, the fourth point may no loner lie in the (displaced) plane Π and may lie to one side or to the other side of Π. From this movement of the fourth point relative to Π, one infers that the Carrier has shifted and/or distorted its position, relative to its initial position.

The analysis presented here in connection with Eqs. (A18)-(A27-3) will be referred to collectively as a "quadratic orientation analysis process."

An initial set of spatial orientation parameters (α0,β0,γ0, p0) may be specified, and corresponding members of a subsequent set (α,β,γ,p) can be compared with (α0,β0,γ0, p0) to determine which of these parameters has changed substantially.

As an example, the Carrier may be an ESW, and the initial plane Π may be substantially horizontal, having direction cosines cos α≈0, cos β≈0 and cos γ≈1 (e.g., cos γ≧0.97). If, at a subsequent time, cos γ≦0.7 for a substantial time interval, corresponding to a Carrier "lean" angle of at least 45°, relative to a vertical direction, the system may conclude that the Carrier is no longer erect and may be experiencing physical or medical problems.

As another example, if (α0,β0,γ0) are substantially unchanged from their initial or reference values but the parameter p is changing substantially, this indicates that the Carrie is moving, without substantial change in the initial posture of the Carrier.

What is claimed is:

1. A system for communication between a central operator and a plurality of mobile communicators, the system comprising:

an operator transceiver and interface, configured to receive and display, for an operator, visually perceptible and audibly perceptible signals from each of N mobile communicators (N≧2), numbered n=1, . . . , N, where the interface (1) presents an audible signal from each communicator as if the audible signal is received from a different location relative to the operator, (2) allows the operator to select, to assign priority to, and to display, in a coordinated manner, the visual signals and the audible signals received from a specified communicator and, (3) associates each of the N communicators with a separate azimuthal angular sector, determined with reference to a selected part of the operator's body, and presents the audible signal from the communicator as if a source of the audible signal is located at the different location within the associated angular sector; and a signal transmitter associated with each of the N communicators, with each transmitter being configured to transmit at least one of the visual signal and the audio signal associated with the communicator.

2. The system of claim 1, wherein said environmental parameter is drawn from a group of environmental and physiological parameters including: length Δt1 of a time interval during which said communicator has remained substantially motionless; length Δt2 of a time interval during which said communicator has remained supine and substantially motionless; length Δt3 of a time interval during which said communicator has not taken a breath; time integrated exposure to a selected chemical in said environment; time-integrated exposure to a selected nuclear radiation component in said environment; time-integrated exposure to sound at or above a selected decibel rating in said environment, heart rate; breathing rate; temperature of a selected body component; and pH of a selected body fluid.

3. The system of claim 1, wherein said signal transmitter is further configured to sense and transmit at least one of (i) location coordinates, in a selected coordinate system, of at least one of said communicators and (ii) angular orientation coordinates, relative to a selected angular format, of at least one of said communicators.

4. A method for communication between a central operator and a plurality of mobile communicators, the method comprising:

providing an operator transceiver and interface, configured to receive and display, for an operator, visually perceptible and audibly perceptible signals from each of N mobile communicators (N≧2), numbered n=1, . . . , N, where the interface (1) presents an audible signal from each communicator as if the audible signal is received from a different location relative to the operator, (2) allows the operator to select, to assign priority to, and to display, in a coordinated manner, the visual signals and the audible signals received from a specified communicator and (3) associates each of the N communicators with a separate azimuthal angular sector, determined with reference to a selected part of the operator's body, and presents the audible signal from the communicator as if a source of the audible signal is located at the different location within the associated angular sector; and providing a signal transmitter, associated with each of the N communicators and configured to transmit at least one of the visual signal and the audio signal associated with the communicator.

5. The method of claim 4, further comprising drawing said environmental parameter from a group of environmental parameters including: length Δt1 of a time interval during which said communicator has remained substantially motionless; length Δt2 of a time interval during which said communicator has remained supine and substantially motionless; length Δt3 of a time interval during which said communicator has not taken a breath; time integrated exposure to a selected chemical in said environment; time-integrated exposure to a selected nuclear radiation component in said environment; time-integrated exposure to sound at or above a selected decibel rating in said environment; heart rate; breathing rate; temperature of a selected body component; and pH of a selected body fluid.

6. The method of claim 4, further comprising configuring said signal transmitter to sense and transmit at least one of (i) location coordinates, in a selected coordinate system, of at least one of said communicators and (ii) angular orientation coordinates, relative to a selected angular format, of at least one of said communicators.

7. A system for communication between a central operator and a plurality of mobile communicators, the system comprising:

an operator transceiver and interface, configured to receive and display, for an operator, visually perceptible and audibly perceptible signals from each of N mobile communicators (N≧2), numbered n=1, . . . , N, where the interface (1) presents an audible signal from each communicator as if the audible signal is received from a different location relative to the operator and (2) allows the operator to select, to assign priority to, and to display, in a coordinated manner, the visual signals and the audible signals received from a specified communicator; and a signal transmitter associated with each of the N communicators, with each transmitter being configured to transmit at least one of the visual signal and the audio signal associated with the communicator, wherein at least one of the signal transmitters comprises at least one environmental sensor that senses and transmits a sensor value representing a selected environmental parameter associated with the communicator;

wherein at least one of the operator interface and the at least one environmental sensor compares the environmental parameter, associated with the communicator number n, with a permitted parameter range and issues an alarm signal if the environmental parameter value does not lie within the permitted parameter range, wherein (i) the operator receives signals from the N communicators on a time shared basis, with signals from the communicator number n being received in a time interval of length $\Delta t(n)$ that does not substantially exceed a time interval length associated with a communicator number n' (n'≠n); (ii) for a selected time interval length T ($T>\Sigma_n\Delta t(n)$), a supplemental time interval of length $\Delta T=T-\Sigma_n\Delta t(n)$ is reserved and is not used by any of the communicators for reporting conventional information; and (iii) when the environmental parameter associated with a communicator number n" does not lie within the permitted parameter range, at least a portion of the supplemental time interval of length $\Delta T$ is assigned for receiving signal from the communicator number n".

8. The system of claim 7, wherein said environmental parameter is drawn from a group of environmental and physiological parameters including: length $\Delta t1$ of a time interval during which said communicator has remained substantially motionless; length $\Delta t2$ of a time interval during which said communicator has remained supine and substantially motionless; length $\Delta t3$ of a time interval during which said communicator has not taken a breath; time integrated exposure to a selected chemical in said environment; time-integrated exposure to a selected nuclear radiation component in said environment; time-integrated exposure to sound at or above a selected decibel rating in said environment, heart rate; breathing rate; temperature of a selected body component; and pH of a selected body fluid.

9. The method of claim 7, wherein said signal transmitter is further configured to sense and transmit at least one of (i) location coordinates, in a selected coordinate system, of at lest one of said communicators and (ii) angular orientation coordinates, relative to a selected angular format, of at least one of said communicators.

10. A method for communication between a central operator and a plurality of mobile communicators, the method comprising:

providing an operator transceiver and interface, configured to receive and display, for an operator, visually perceptible and audibly perceptible signals from each of N mobile communicators (N≧2), numbered n=1, . . . , N, where the interface (1) presents an audible signal from each communicator as if the audible signal is received from a different location relative to the operator and (2) allows the operator to select, to assign priority to, and to display, in a coordinated manner the visual signals and the audible signal received from a specified communicator; and providing a signal transmitter, associated with each of the N communicators and configured to transmit at least one of the visual signal and the audio signal associated with the communicator, wherein at least one of the signal transmitters comprises at least one environmental sensor that senses and transmits a sensor value representing a selected environmental parameter associated with the communicator;

wherein at least one of the operator interface and the at least one environmental sensor compares the environmental parameter, associated with the communicator number n, with a permitted parameter range and issues an alarm signal if the environmental parameter value does not lie within the permitted parameter range, wherein (i) the operator receives signals from the N communicators on a time shared basis, with signals from the communicator number n being received in a time interval of length $\Delta t(n)$ that does not substantially exceed a time interval length associated with a communicator number n' (n'≠n); (ii) for a selected time interval length T ($T>\Sigma_n\Delta t(n)$), a supplemental time interval of length $\Delta T=T-\Sigma_n\Delta t(n)$ is reserved and is not used by any of the communicators for reporting conventional information; and (iii) when the environmental parameter associated with a communicator number n" does not lie within the permitted parameter range, at least a portion of the supplemental time interval of length $\Delta T$ is assigned for receiving signals from the communicator number n".

11. The method of claim 10, further comprising drawing said environmental parameter from a group of environmental parameters including: length $\Delta t1$ of a time interval during which said communicator has remained substantially motionless; length $\Delta t2$ of a time interval during which said communicator has remained supine and substantially motionless; length $\Delta t3$ of a time interval during which said communicator has not taken a breath; time integrated exposure to a selected chemical in said environment; time-integrated exposure to a selected nuclear radiation component in said environment; time-integrated exposure to sound at or above a selected decibel rating in said environment; heart rate; breathing rate; temperature of a selected body component; and pH of a selected body fluid.

12. The method of claim 10, further comprising configuring said signal transmitter to sense and transmit at least one of (i) location coordinates, in a selected coordinate system, of at least one of said communicators and (ii) angular orientation coordinates, relative to a selected angular format, of at least one of said communicators.

* * * * *